US010571214B2

(12) United States Patent
Barnett

(10) Patent No.: US 10,571,214 B2
(45) **Date of Patent: *Feb. 25, 2020**

(54) CROSSBOW TRACK ASSEMBLY

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/206,587

(22) Filed: Nov. 30, 2018

(65) Prior Publication Data

US 2019/0093980 A1 Mar. 28, 2019

Related U.S. Application Data

(60) Continuation of application No. 15/386,089, filed on Dec. 21, 2016, now Pat. No. 10,175,022, which is a (Continued)

(51) Int. Cl.
*F41B 5/12* (2006.01)
*F41B 5/14* (2006.01)

(52) U.S. Cl.
CPC ..... *F41B 5/12* (2013.01); *F41B 5/123* (2013.01); *F41B 5/1403* (2013.01); *F41B 5/1426* (2013.01); *F41B 5/1469* (2013.01)

(58) Field of Classification Search
CPC ..... F41B 5/1403; F41B 5/12; F41B 5/123; F41B 5/1469; F41B 5/1426
See application file for complete search history.

(56) References Cited

U.S. PATENT DOCUMENTS 5,927,041 A * 7/1999 Sedlmeier ..... E04B 9/064 248/49
8,443,790 B2 * 5/2013 Pestrue ..... F41B 5/1469 124/25

(Continued)

OTHER PUBLICATIONS

U.S. Appl. No. 15/386,089, Inventor: David A. Barnett, Applicant: Barnett Outdoors, LLC, filed Dec. 21, 2016 (co-pending application).

(Continued)

*Primary Examiner* — Jeffrey S Vanderveen
(74) *Attorney, Agent, or Firm* — Jones Walker LLP

(57) ABSTRACT

A crossbow track assembly includes a crossbow track having a top surface and a side surface. The top surface includes an arrow track. The side surface includes a longitudinal passage leading to a longitudinal cavity. The side surface forms an upper shoulder and a lower shoulder of the longitudinal cavity. A second side surface may include a second longitudinal passage leading to a second longitudinal cavity. The second side surface may form an upper shoulder and a lower shoulder of the second longitudinal cavity. The crossbow track assembly may further include a crossbow accessory including an accessory body operatively connected to a plug, which is dimensioned to fit within the longitudinal cavity of the crossbow track for securing the accessory body to the crossbow track. The accessory body may be adjustably connected to the plug with a fastener. Alternatively, the plug may be in sliding engagement with the longitudinal cavity.

25 Claims, 14 Drawing Sheets

Related U.S. Application Data division of application No. 14/589,589, filed on Jan. 5, 2015, now Pat. No. 9,562,735.

(56) References Cited

U.S. PATENT DOCUMENTS

| | | | | |
|---|---|---|---|---|
| 2013/0174825 | A1* | 7/2013 | Bednar | F41B 5/1426 124/88 |
| 2013/0213371 | A1* | 8/2013 | Biafore, Jr. | F41B 5/123 124/25 |
| 2016/0209158 | A1* | 7/2016 | Park | F41B 5/1426 |

OTHER PUBLICATIONS

U.S. Appl. No. 15/244,779, Inventor: David A. Barnett, Applicant: Barnett Outdoors, LLC, filed Aug. 23, 2016 (co-pending application).

* cited by examiner

CROSSBOW TRACK ASSEMBLY

CROSS-REFERENCE TO RELATED APPLICATIONS

This application is a continuation of and claims priority to U.S. patent application Ser. No. 15/386,089, filed on Dec. 21, 2016, which is a divisional of U.S. patent application Ser. No. 14/589,589, filed on Jan. 5, 2015, now issued as U.S. Pat. No. 9,562,735, all of which are incorporated by reference herein.

DETAILED DESCRIPTION OF THE PREFERRED EMBODIMENTS

Figure 1:
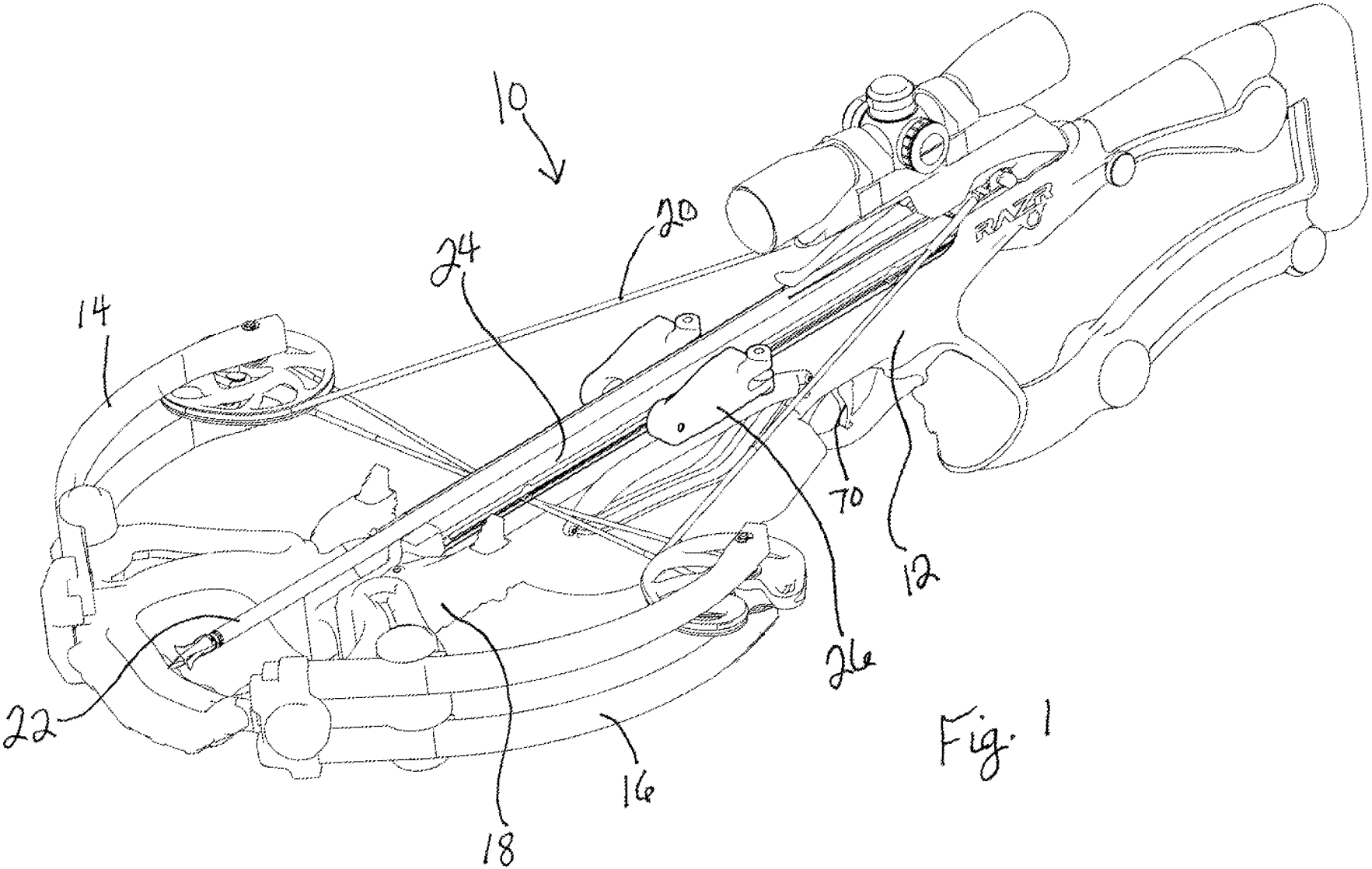
FIG. 1 is a perspective view of a crossbow of the present disclosure.

A crossbow may include a track assembly including a longitudinal cavity configured to allow crossbow accessories to be attached to the track assembly. FIG. 1 illustrates crossbow 10 including stock 12. Bow limbs 14 and 16 are operatively attached to forward end 18 of stock 12. For example, bow limbs 14 and 16 may be attached to forward end 18 through a riser or through a foot stirrup. String 20 may be operatively connected to bow limbs 14 and 16. String 20 may be pulled from a resting position into a cocked position. With crossbow 10 in a cocked position as shown, arrow 22 may rest upon track 24, which is connected to an upper portion of stock 12. Crossbow accessory 26 may be attached to track 24. Any number of crossbow accessories may be designed to be attached to track 24.

Figure 2:
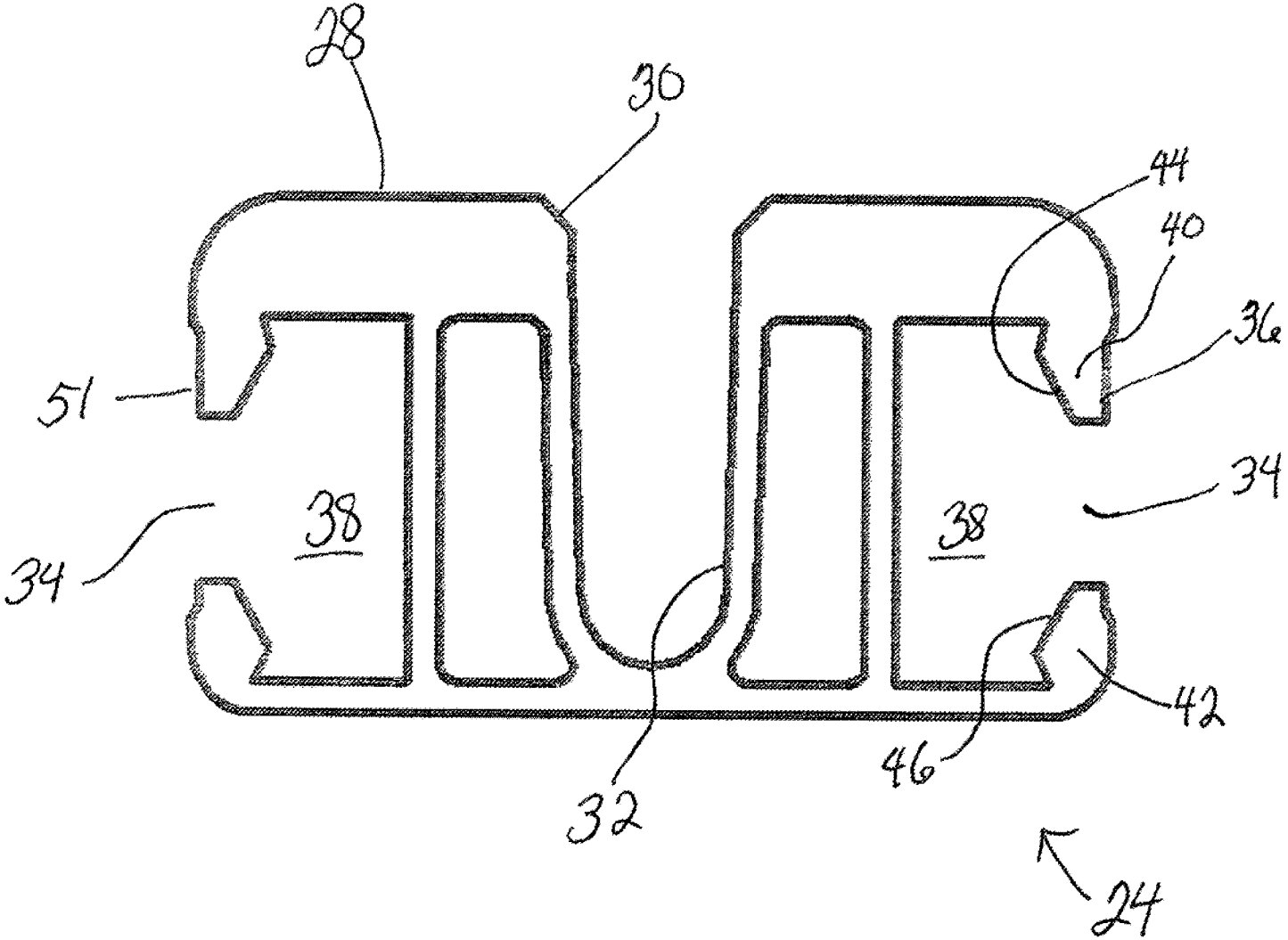
FIG. 2 is a front view of a track of the crossbow.

With reference to FIG. 2, track 24 may include top surface 28 having arrow track 30. Arrow track 30 may extend to flight groove 32. Track 24 may also include longitudinal passage 34 extending from side surface 36 into longitudinal cavity 38. Upper shoulder 40 and lower shoulder 42 may be formed by side surface 36. Upper shoulder 40 may include tapered internal surface 44, and lower shoulder 42 may include tapered internal surface 46. Longitudinal cavity 38 may include one or more open ends 47 (shown in FIG. 7). Longitudinal cavity 38 may have a dovetail cross-section as shown in FIG. 2. The height of longitudinal cavity 38 is greater than the height of longitudinal passage 34. In one embodiment, side surface 51 of track 24 may also include longitudinal passage 34 and longitudinal cavity 38 having the same features as longitudinal passage 34 and longitudinal cavity 38 of side surface 36 described above.

Figure 3:
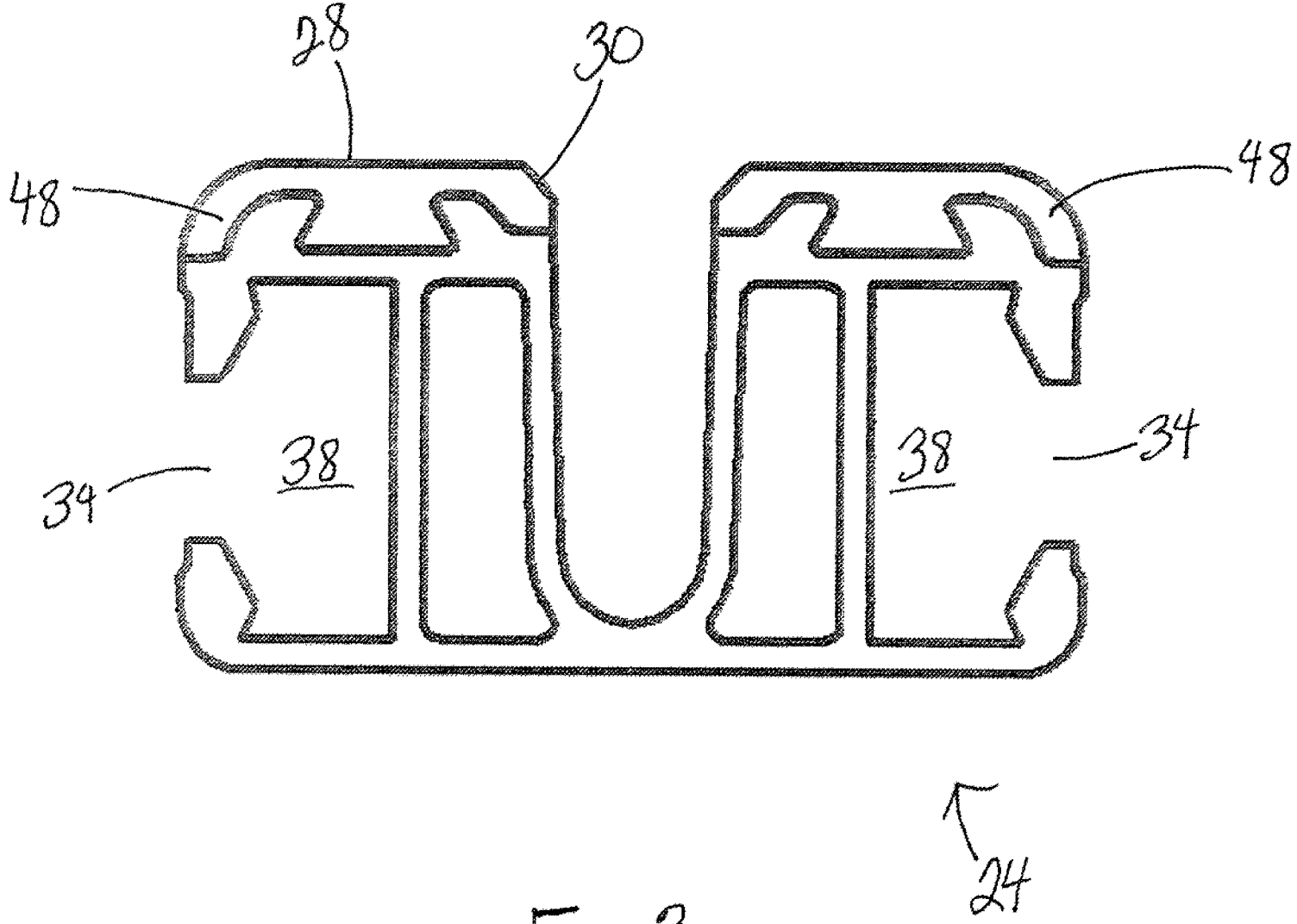
FIG. 3 is an alternate front view of the track of the crossbow.

FIG. 3 illustrates an alternate embodiment of track 24 in which top surface 28 is formed by plate members 48. Plate members 48 may be formed separately from the remainder of track 24. It should be understood that track 24 described herein may, but is not limited to, a track that includes one or more separate plate members forming its top surface and arrow track.

Figure 4:
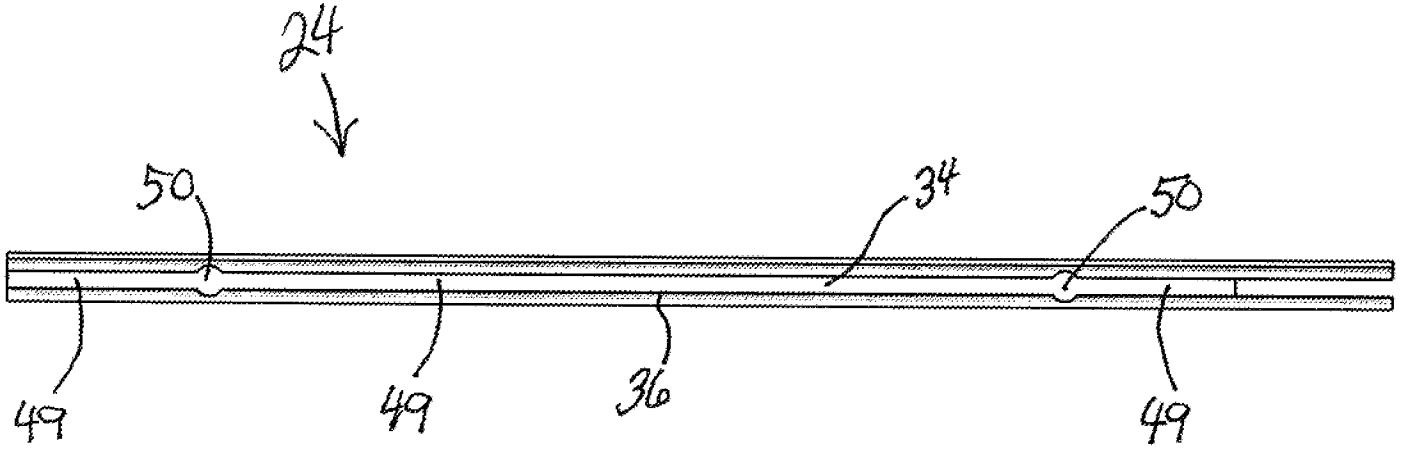
FIG. 4 is a side view of the track of the crossbow.

With reference to FIG. 4, longitudinal passage 34 may include one or more linear portions 49 and one or more access ports 50. The height of access ports 50 may be greater than linear portions 49. Track 24 may be formed of aluminum, another metal, or other durable material.

Figure 5:
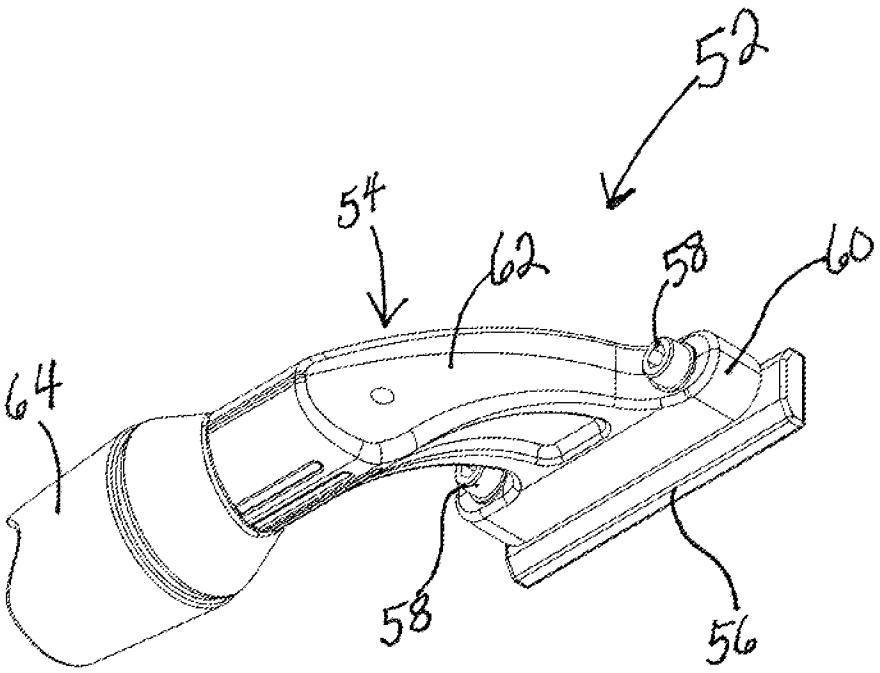
FIG. 5 is a perspective view of a string dampener configured to operatively connect to the track of the crossbow.
Figure 6:
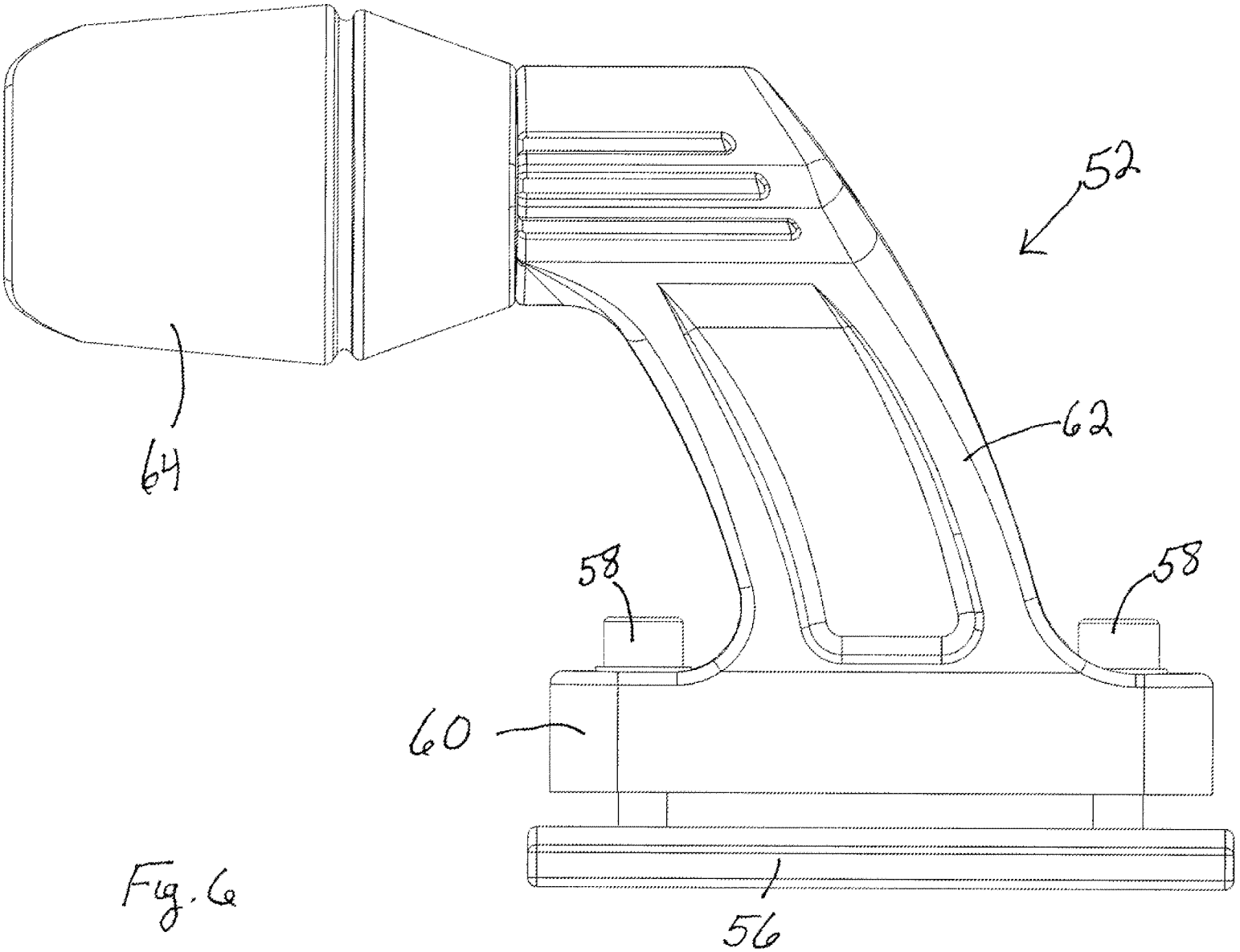
FIG. 6 is a top view of the string dampener.

Referring to FIGS. 5 and 6, string dampener 52 may be configured to be attached to track 24. String dampener 52 may include body 54 and plug 56. Fasteners 58 may secure body 54 to plug 56. Fasteners 58 may be formed of bolts, screws, or any other suitable fastening mechanism. Alternatively, plug 56 may be integrally formed with body 54. Body 54 may include base 60 including bores for receiving fasteners 58. Arm 62 may extend from base 60 to dampening member 64. Dampening member 64 may be formed of a thermoplastic elastomer (TPE), another polymer, or any other material capable of reducing vibration of crossbow 10 upon absorbing an impact from string 20. Arm 62, base 60, and plug 56 may be formed of aluminum, other metals, polymer, or any other durable material. In one embodiment, plug 56 may be formed of a longitudinal member.

Figure 7:
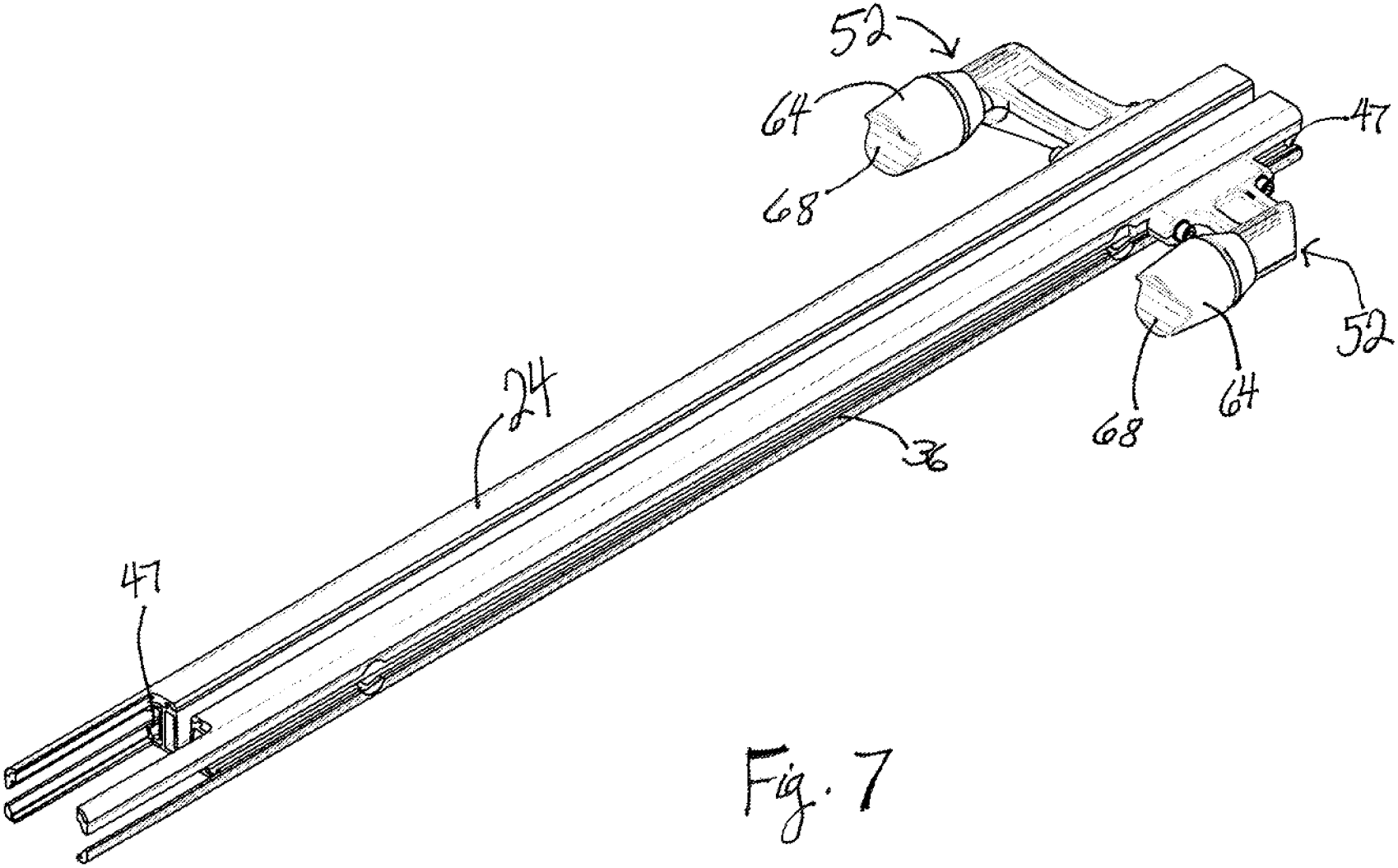
FIG. 7 is a perspective view of the string dampener connected to the track.
Figure 8:
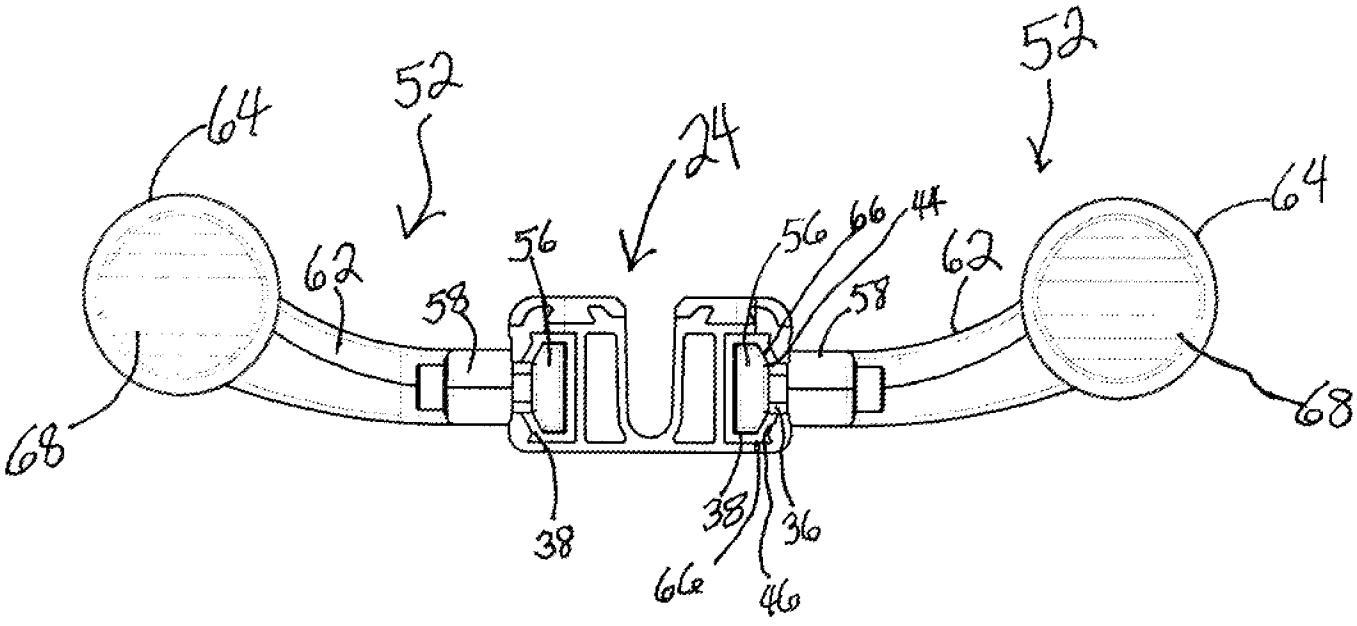
FIG. 8 is a rear view of the string dampener connected to the track.

FIGS. 7 and 8 illustrate two string dampeners 52 attached to track 24. With body 54 of each string dampener 52 separated from plugs 56, each plug 56 may slide into open end 47 of longitudinal cavity 38. Base 60 of each string dampener 52 may be positioned at side surfaces 36, 51 of track 24 over plug 56. Fasteners 58 may be inserted through the bores in base 60, through longitudinal passage 34, and into plug 56. Tightening fasteners 58 may secure body 54 of each string dampener 52 onto track 24. Further tightening of fasteners 58 may draw tapered surfaces 66 of each plug 56 into contact with tapered internal surfaces 44 and 46 to prevent string dampener 52 from sliding along track 24. Face 68 of each dampening member 64 may be perpendicularly oriented relative to side surfaces 36, 51 of track 24.

String dampeners 52 may be used to reduce the vibration associated with releasing string 20 from the cocked position shown in FIG. 1. String dampeners 52 may be positioned on track 24 near front end 18 of stock 12 with dampening members 64 facing rearwardly. When string 20 is fired (by pulling trigger 70), string 20 may impact dampening members 64, which may absorb energy from string 20 such that a user feels less vibration through crossbow 10.

Figure 9:
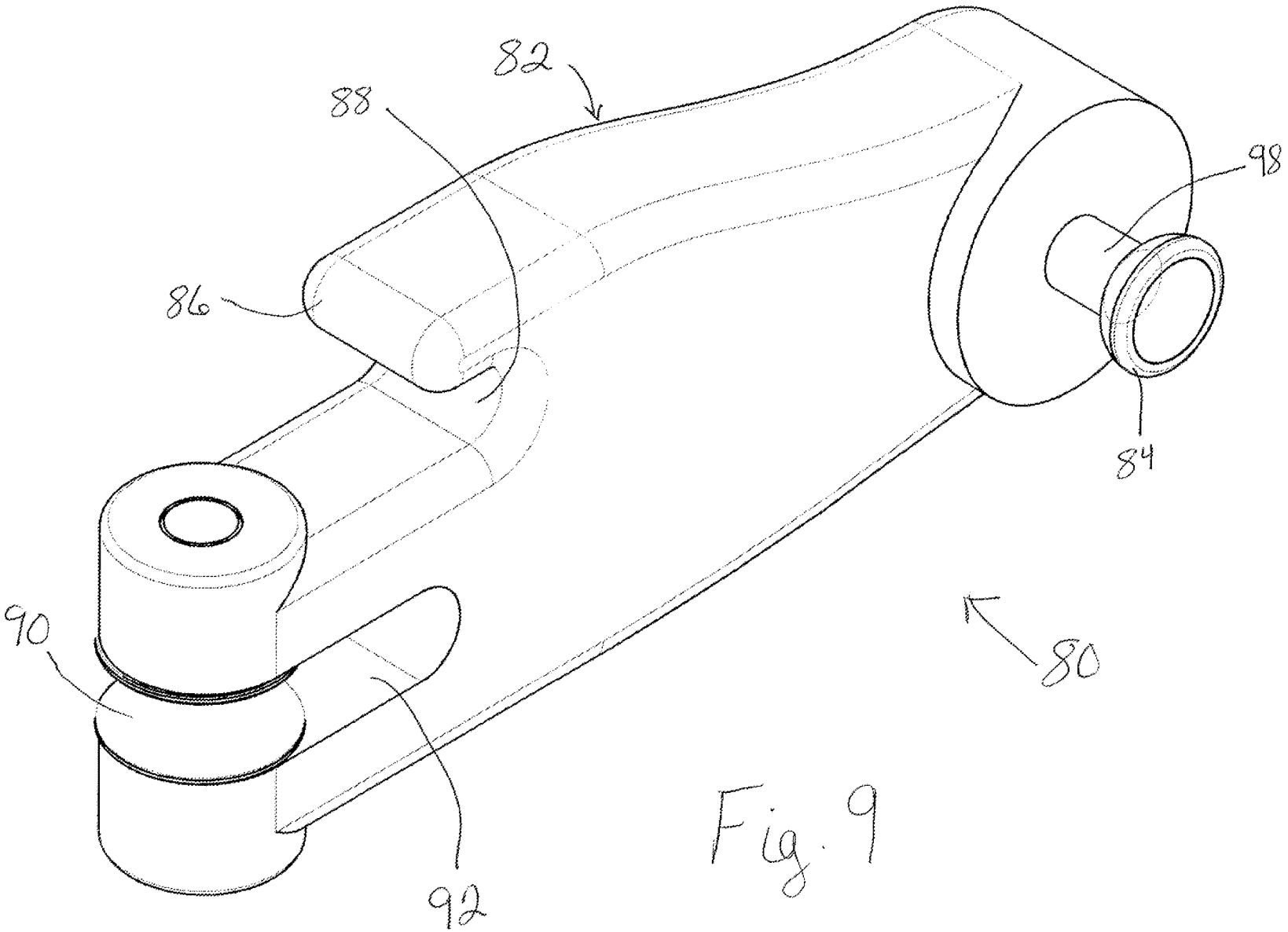
FIG. 9 is a side perspective view of a cocking device configured to operatively connect to the track of the crossbow.
Figure 10:
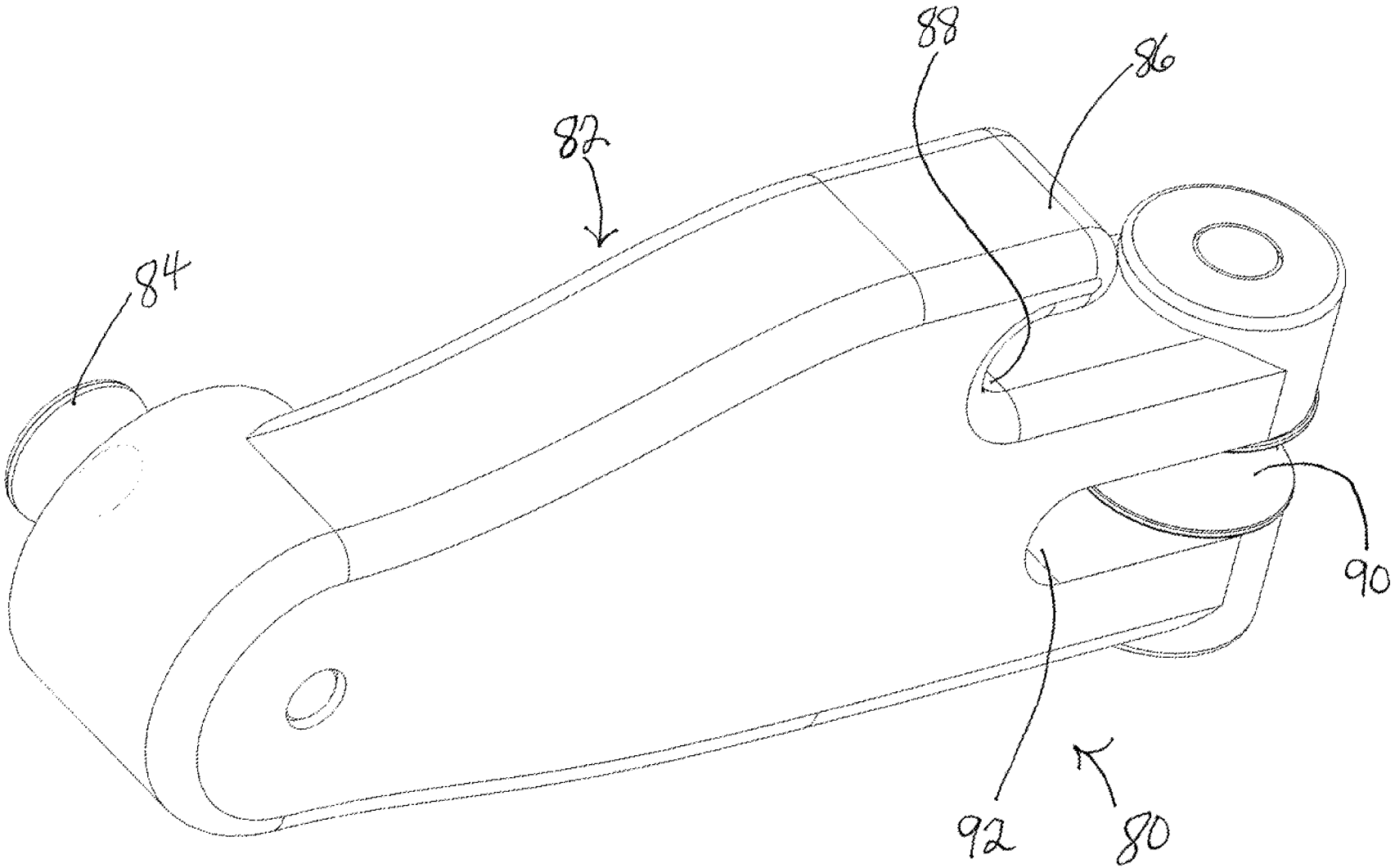
FIG. 10 is an opposite side perspective view of the cocking device.
Figure 11:
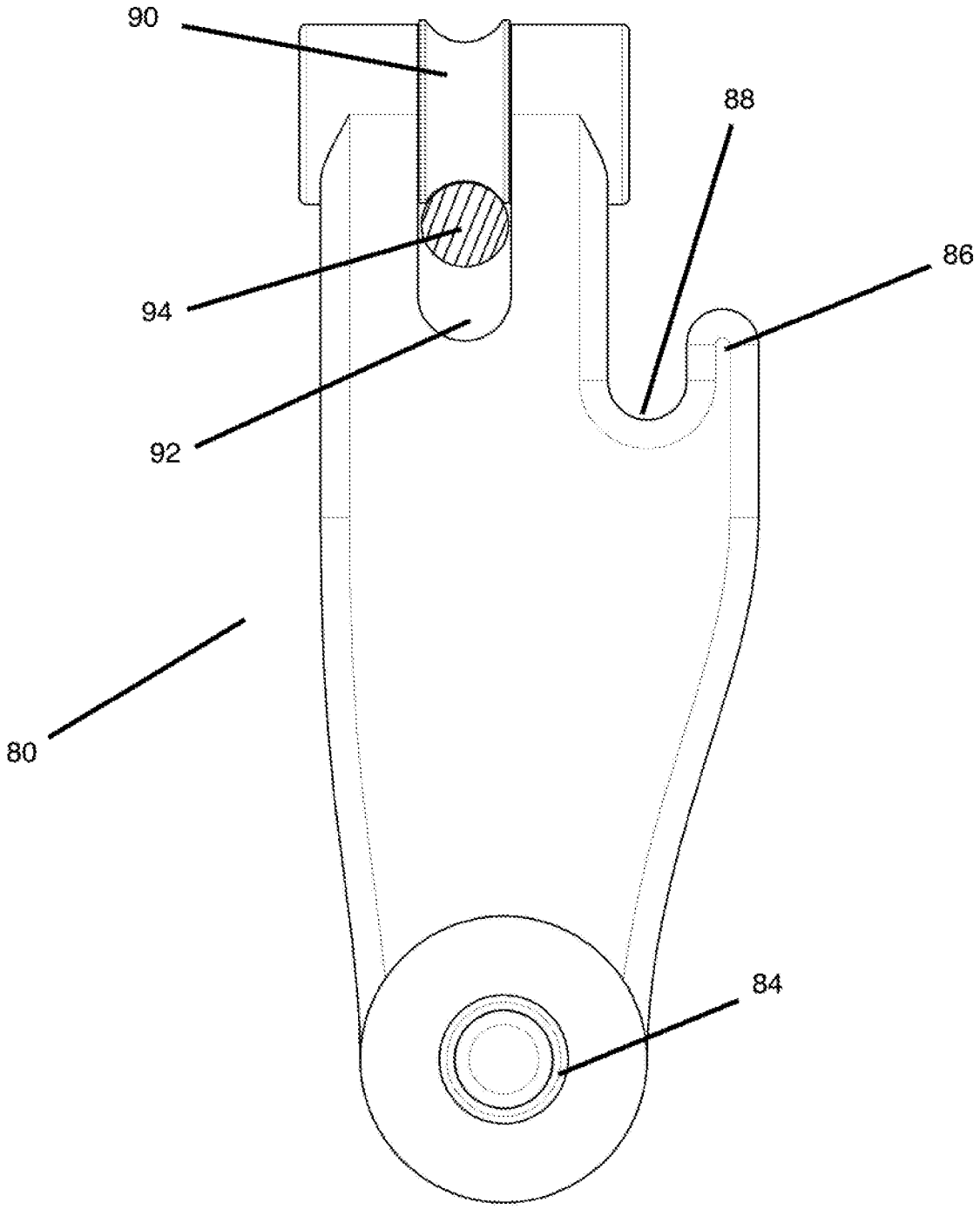
FIG. 11 is a side view of the cocking device.

With reference to FIGS. 9-11, cocking device 80 may be configured to be attached to track 24. Cocking device 80 may include body 82 and plug 84. Body 82 may include hook 86 and hook surface 88. Body 82 may also include spool surface 90 enclosing aperture 92. Aperture 92 may be dimensioned to allow passage of rope member 94 therethrough. Rope member 94 may be formed of a rope, string, or other durable linear member. Spool surface 90 may include a concave circumferential surface, which may guide rope member 94 to a center of the spool surface 90 for balance purposes. Rope member 94 may partially wrap around and slide along spool surface 90 during use. Post 98 may connect body 82 of cocking device 80 to plug 84. In one embodiment, plug 84 may include a circularly-shaped end. Body 82 and plug 84 may be formed of aluminum, a polymer, or any other durable material. Body 82, post 98, and plug 84 may be integrally formed. Alternatively, body 82, post 98, and plug 84 may be formed separately and connected to one another.

Figure 12:
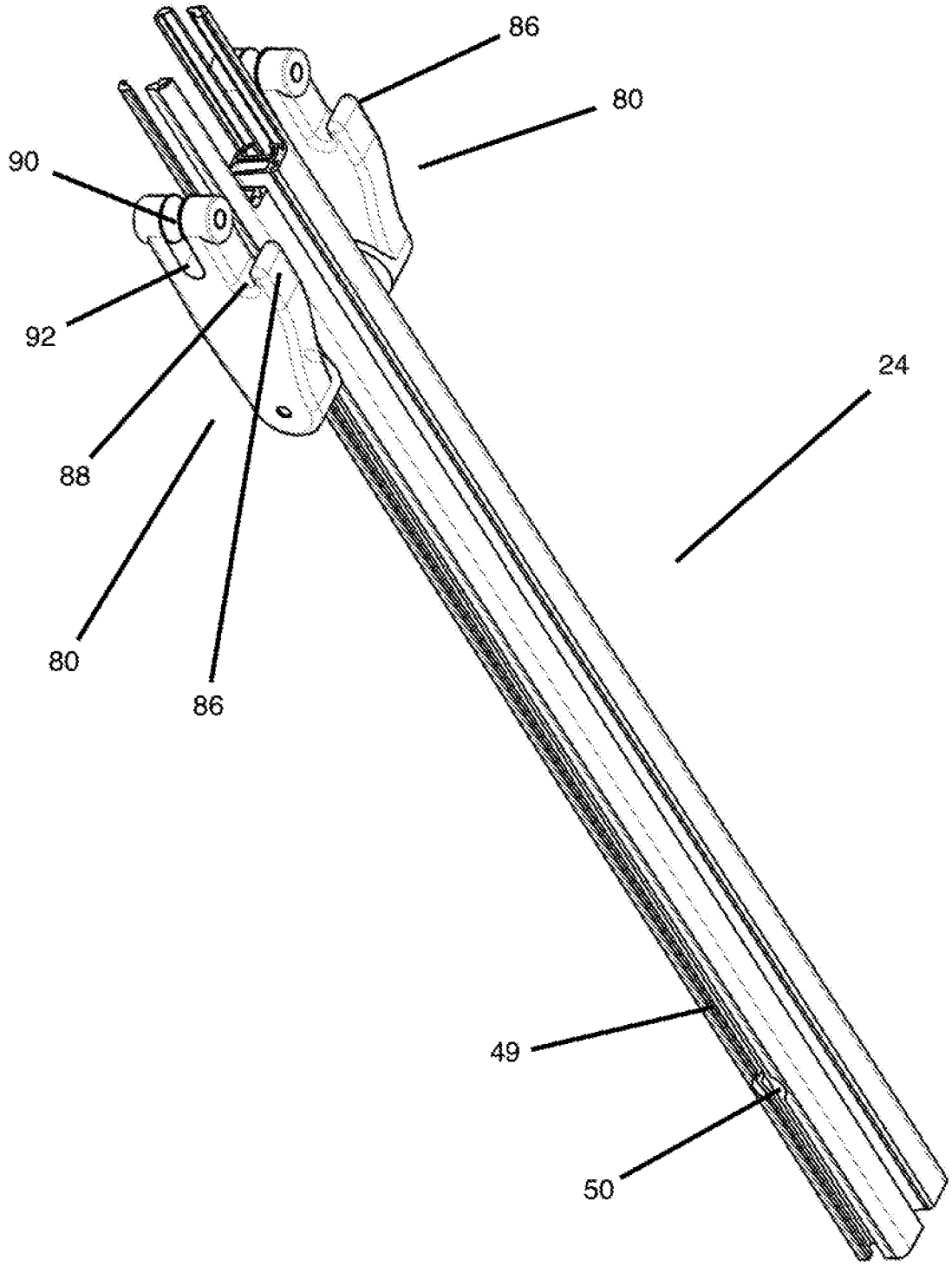
FIG. 12 is a perspective view of the cocking device connected to the track.
Figure 13:
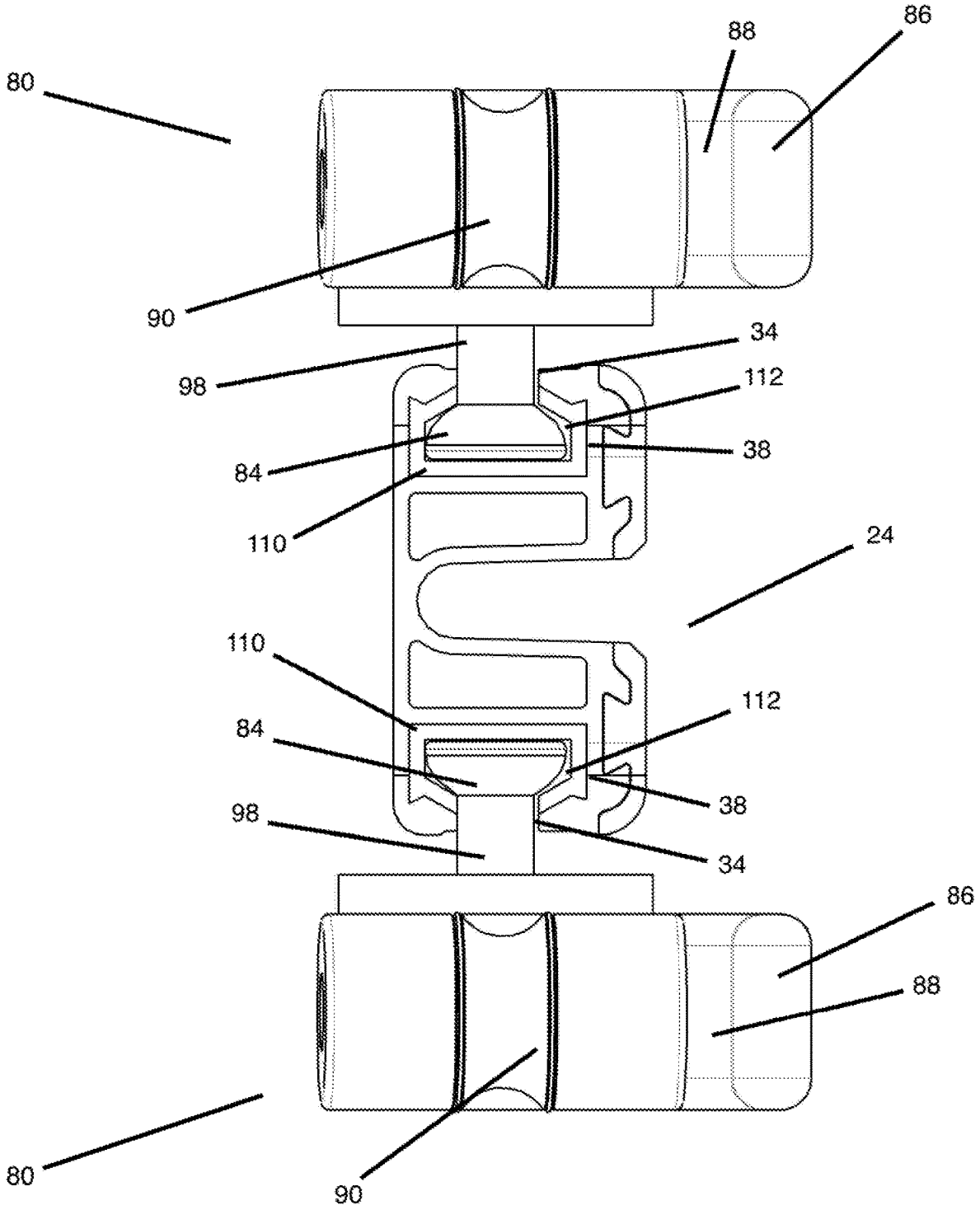
FIG. 13 is a rear view of the cocking device connected to the track.

FIGS. 12 and 13 illustrate two cocking devices 80 attached to track 24. Each plug 84 may be inserted into an access port 50. Access ports 50 and plugs 84 may have cooperating shapes and sizes such that plug 84 may be inserted through access ports 50. When track 24 is attached to crossbow 10 in the resting position, plugs 84 may be inserted into access ports 50 located near front end 18 of stock 12 (shown in FIG. 1). As readily understood by one of ordinary skill in the art, one or more rope members 94 may be inserted through aperture 92 of each cocking device 80. Cocking devices 80 may be pulled rearwardly by rope member 94 in order to engage string 20 of crossbow 10 (shown in FIG. 1) with hook 86 and hook surface 88 of each cocking device 80. As cocking devices 80 are pulled rearwardly, each plug 84 may slide along the length of longitudinal cavity 38. The reduced height of linear portions 49 of longitudinal passage 34 relative to access ports 50 may prevent plug 84 from slipping out of longitudinal cavity 38 while plug 84 slides along linear portions 49. Post 98 may be disposed through longitudinal passage 34 as cocking device 80 slides along track 24 with plug 84 in longitudinal cavity 38. Pulling cocking devices 80 further in the rearward direction will pull string 20 into the cocked position. Once string 20 engages a trigger catch, cocking devices 80 may be removed by pulling each plug 84 through an access port 50 of track 24. For example, each plug 84 may be removed by being pulled through an access port located near the trigger catch.

In one embodiment, sleeve 110 may be disposed within longitudinal cavity 38 and plug 84 may slide along inner cavity 112 of sleeve 110. Sleeve 110 may be used to facilitate the sliding of plug 84 within longitudinal cavity 38. Sleeve 110 may also stabilize plug 84 as it slides within longitudinal cavity 38. Sleeve 110 may be formed of a polymer, ceramic, or any other material capable of providing a smooth surface to ease friction associated with sliding of plug 84.

Figure 14:
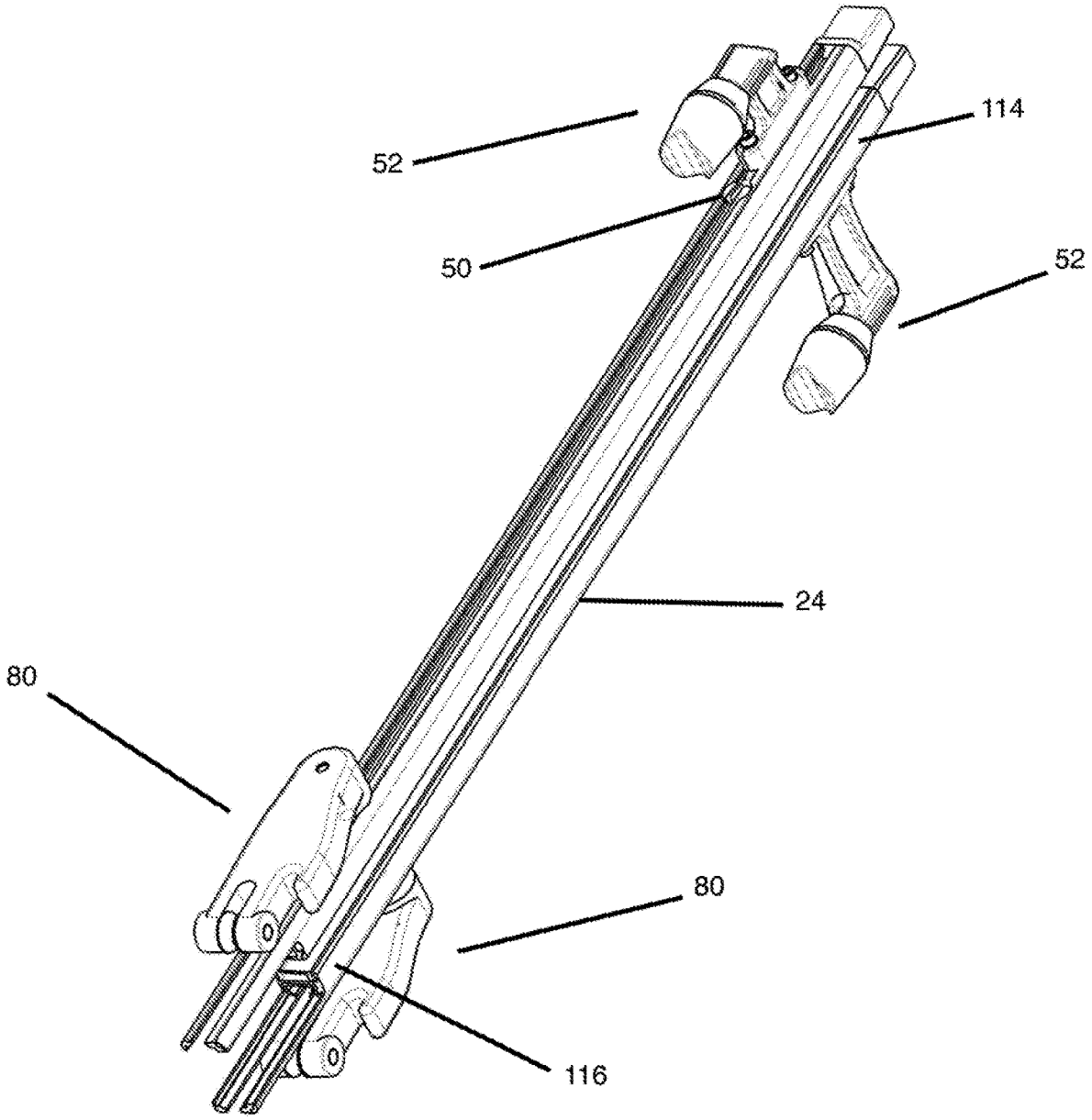
FIG. 14 is a perspective view of the string dampener and the cocking device connected to the track.

Referring now to FIG. 14, two string dampeners 52 and two cocking devices 80 may be attached to track 24 simultaneously. String dampeners 52 may be attached to track 24 near front end 114. String dampeners 52 may be attached to track 24 in front of all access ports 50 such that cocking devices 80 may be inserted into access ports 50 near front end 114 of track 24 and may be pulled to, and remove through, other access ports 50 located near rearward end 116 of track 24. In this way, track 24 may be configured to simultaneously attach more than one type of crossbow accessory 26 to crossbow 10.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A crossbow comprising:

a stock including a forward end and a rearward end;

a pair of bow limbs operatively attached to the forward end of the stock;

a crossbow track assembly comprising a crossbow track having a top surface and a side surface, the top surface including an arrow track, the side surface including a longitudinal passage leading to a longitudinal cavity, wherein the side surface forms an upper shoulder and a lower shoulder of the longitudinal cavity, and wherein both the longitudinal passage and the longitudinal cavity extend substantially the entire length of the crossbow track; and wherein the longitudinal passage includes a linear portion and an access port, wherein the access port has an expanded height relative to the linear portion.

2. The crossbow of claim 1, wherein the longitudinal cavity has a dovetail cross-section.

3. The crossbow of claim 1, wherein the upper shoulder includes a tapered internal surface and the lower shoulder includes a tapered internal surface.

4. The crossbow of claim 1, wherein the longitudinal cavity has an expanded height relative to the longitudinal passage.

5. The crossbow of claim 1, further comprising a crossbow accessory including an accessory body and a plug, wherein the plug is dimensioned to fit within the longitudinal cavity of the crossbow track for securing the accessory body to the crossbow track.

6. The crossbow of claim 5, wherein the plug is connected to the body through a fastening member.

7. The crossbow of claim 5, wherein the plug is integrally formed with the body.

8. The crossbow of claim 5, wherein the accessory body is adjustably connected to the plug with a fastener for immobilizing the accessory body on the crossbow track, wherein the plug engages the upper and lower shoulders of the longitudinal cavity.

9. The crossbow of claim 8, wherein the fastener is disposed through the longitudinal passage, and wherein the accessory body includes a string dampener.

10. The crossbow of claim 9, wherein the string dampener includes an arm interconnecting a dampening member and a base, wherein the base includes a bore dimensioned to receive the fastener, wherein a face of the dampening member is perpendicularly oriented relative to the side surface of the crossbow track.

11. The crossbow of claim 5, wherein the plug is in sliding engagement with the longitudinal cavity.

12. The crossbow of claim 11, wherein the access port is dimensioned to receive the plug.

13. The crossbow of claim 12, wherein the accessory body includes a cocking device.

14. The crossbow of claim 13, wherein the cocking device includes a hook configured for engaging a crossbow string, and wherein the cocking device further includes an aperture dimensioned to receive a rope member therethrough for pulling the cocking device and the crossbow string.

15. The crossbow of claim 5, further comprising a longitudinal sleeve disposed within the longitudinal cavity, wherein the plug is in sliding engagement with the longitudinal sleeve.

16. The crossbow of claim 1, wherein both the longitudinal passage and the longitudinal cavity extend the entire length of the crossbow track.

17. A crossbow comprising:

a stock including a forward end and a rearward end;

a pair of bow limbs operatively attached to the forward end of the stock;

a crossbow track assembly comprising a crossbow track having a top surface, a first side surface, and a second side surface, the top surface including an arrow track, the first side surface including a first longitudinal passage leading to a first longitudinal cavity, the second side surface including a second longitudinal passage leading to a second longitudinal cavity, wherein the first side surface forms a first upper shoulder and a first lower shoulder of the first longitudinal cavity, wherein the second side surface forms a second upper shoulder and a second lower shoulder of the second longitudinal cavity, and wherein the first and second longitudinal passages and the first and second longitudinal cavities extend substantially the entire length of the crossbow track; and wherein the first and second longitudinal passages each includes a linear portion and an access port, wherein the access ports each have an expanded height relative to the linear portions.

18. The crossbow of claim 17, wherein the first and second longitudinal cavities each has a dovetail cross-section.

19. The crossbow of claim 17, wherein the first and second upper shoulders each includes a tapered internal surface, and wherein the first and second lower shoulders each includes a tapered internal surface.

20. The crossbow of claim 17, wherein the first and second longitudinal cavities each has an expanded height relative to the first and second longitudinal passages.

21. The crossbow of claim 17, wherein the first and second longitudinal passages and the first and second longitudinal cavities extend the entire length of the crossbow track.

22. A crossbow comprising:

a stock including a forward end and a rearward end;

a pair of bow limbs operatively attached to the forward end of the stock;

a crossbow track having a top surface, a first side surface, and a second side surface, the top surface including an arrow track, the first side surface including a first longitudinal passage leading to a first longitudinal cavity, the second side surface including a second longitudinal passage leading to a second longitudinal cavity, wherein the first side surface forms a first upper shoulder and a first lower shoulder of the first longitudinal cavity, and wherein the second side surface forms a second upper shoulder and a second lower shoulder of the second longitudinal cavity; wherein the first and second longitudinal passages and the first and second longitudinal cavities extend substantially the entire length of the crossbow track; and wherein the first and second longitudinal passages each includes a linear portion and an access port, the access ports each having an expanded height relative to the linear portions; and a crossbow accessory including an accessory body and a plug, wherein the plug is dimensioned to fit within the first longitudinal cavity or the second longitudinal cavity of the crossbow track in a sliding engagement for securing the accessory body to the crossbow track, and wherein the access port of the first longitudinal passage and the access port of the second longitudinal passage are both dimensioned to receive the plug.

23. The crossbow of claim 22, wherein the first and second longitudinal cavities each has a dovetail cross-section.

24. The crossbow of claim 22, wherein the first and second upper shoulders each includes a tapered internal surface, and wherein the first and second lower shoulders each includes a tapered internal surface.

25. The crossbow of claim 22, wherein the first and second longitudinal cavities each has an expanded height relative to the first and second longitudinal passages.

* * * * *